US006378232B1

(12) United States Patent
Creech

(10) Patent No.: US 6,378,232 B1
(45) Date of Patent: Apr. 30, 2002

(54) DISPLAY AND SCOREBOARDS WITH ROTARY MOUNTING CLAMPS

(75) Inventor: Gene Creech, Reno, NV (US)

(73) Assignee: Eagle Scoreboard Systems, Inc., Reno, NV (US)

( * ) Notice: Subject to any disclaimer, the term of this patent is extended or adjusted under 35 U.S.C. 154(b) by 0 days.

(21) Appl. No.: 09/405,212

(22) Filed: Sep. 27, 1999

(51) Int. Cl.[7] ..... G09F 7/02

(52) U.S. Cl. ..... 40/611; 40/493; 40/606; 248/474

(58) Field of Search ..... 40/611, 606, 492, 40/493; 248/474, 473, 131; 403/119, 65, 52, 164

(56) References Cited

U.S. PATENT DOCUMENTS

| | | | | | |
|---|---|---|---|---|---|
| 128,503 | A | * | 7/1872 | Patterson | 16/339 |
| 241,925 | A | * | 5/1881 | Cadwell | 40/493 |
| 413,679 | A | | 10/1889 | Obergh | |
| 458,331 | A | | 8/1891 | Arnold | |
| 522,980 | A | * | 7/1894 | Fleming | 40/493 |
| 1,914,068 | A | * | 6/1933 | Birnn | 40/764 |
| 2,388,180 | A | | 10/1945 | Pulver, Jr. | |
| 2,454,648 | A | * | 11/1948 | Green | 40/606 |
| 3,899,164 | A | * | 8/1975 | Newman | 269/71 |
| 4,134,222 | A | | 1/1979 | Orsos | |
| 4,280,294 | A | * | 7/1981 | Eckberg, II | 40/606 |
| 4,530,177 | A | | 7/1985 | Kane | |
| 5,251,570 | A | * | 10/1993 | Creech | 116/225 |
| 5,400,992 | A | * | 3/1995 | Pohl | 40/606 |
| 5,492,476 | A | | 2/1996 | Ball et al. | |
| 5,694,881 | A | * | 12/1997 | Creech | 116/222 |
| 5,906,064 | A | * | 5/1999 | Field | 40/606 |
| 5,944,896 | A | * | 8/1999 | Landesman et al. | 248/131 |
| 6,095,226 | A | * | 8/2000 | Chen et al. | 160/135 |

* cited by examiner

*Primary Examiner*—B. Dayoan
*Assistant Examiner*—William L. Miller
(74) *Attorney, Agent, or Firm*—Dowell & Dowell, P.C.

(57) ABSTRACT

Display devices such as scoreboards having reversible display surfaces are mounted to support frames using opposing clamps each having a pivot post extending therefrom. The clamps engage one of the boards or frames with the posts being seated in openings in the other of the boards or frames. One or more latches extend between the support frames and boards to prevent rotation of the boards when in a locked position.

10 Claims, 2 Drawing Sheets

Fig. 3
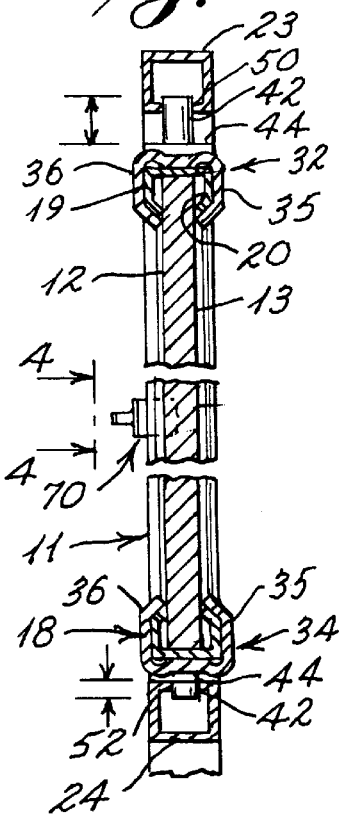
Fig. 4
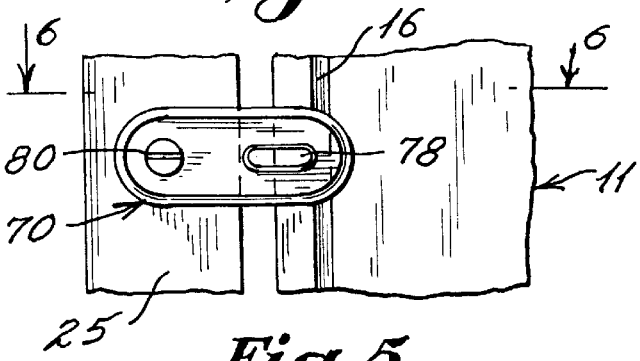
Fig. 5
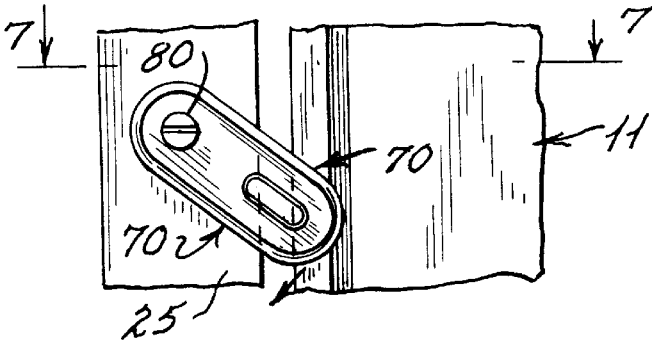
Fig. 6
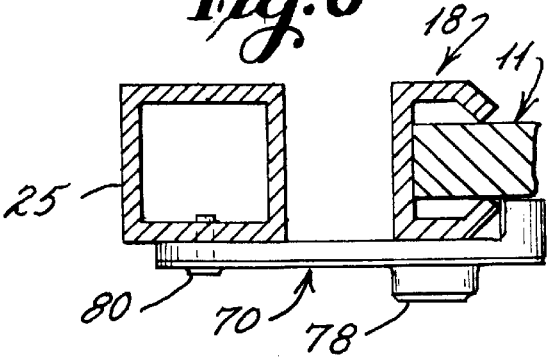
Fig. 7
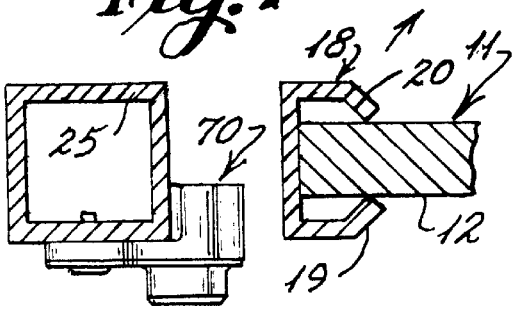
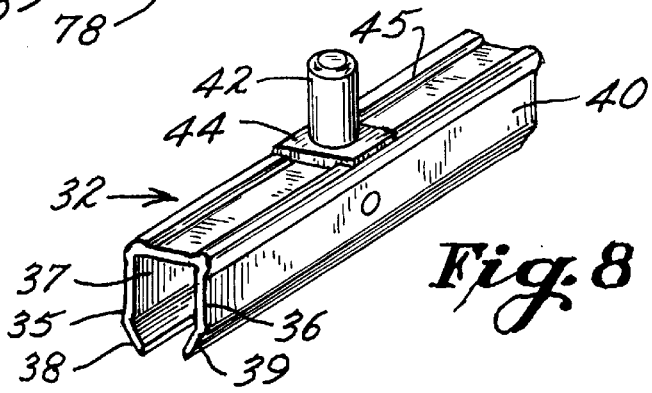
Fig. 8

DISPLAY AND SCOREBOARDS WITH ROTARY MOUNTING CLAMPS

BACKGROUND OF THE INVENTION

1. Field of the Invention

This invention is generally directed to display boards of a type which are used to display information to a viewer and particularly to such displays as scoreboards having opposing display surfaces and which may be selectively mounted so that either display surface may be selectively oriented outwardly with respect to a front of a frame to which such display boards are mounted.

2. History of the Related Art

Display boards are utilized in many different environments including educational, business, recreational, transportation, commercial, retail, and home or living environments. Many displays are designed to be permanently mounted to a wall and include a single display surface upon which information may be placed or recorded. The problem with fixed display boards is that only a single display surface is utilized and therefore the amount of information which can be conveyed from a single display is limited. Further, fixed displays are not always placed in the most appropriate area to convey the information displayed thereon.

In U.S. Pat. No. 5,251,570 to the same inventor as the present invention, a display in the form of a scoreboard system is disclosed which allows scoreboards to be either mounted on a fixed surface such as a wall or frame, or on a mobile carrier. Also, the boards associated with the system are easily removable and reversible. By providing scoreboards having a plurality of varying displays, each of which is reversible, a single system may be utilized to convey a greater amount of information and may also be utilized for a plurality of purposes which would not otherwise by possible with a system having a single display surface. In the aforementioned patent, scoreboards are reversibly mounted to a support frame such that they can carry various indicia thereon and also having various indicia or information recorded thereon. Utilizing the system, it is possible to provide boards having predetermined charts thereon of a type, for example, frequently used in the game of golf. By reversing and reorienting the various combinations of display boards, it is possible to form different charts for different types of tournament play. Such a scoreboard system therefore offers not only increased utility over prior art fixed scoreboard systems but also reduces the cost of the system as display elements provide an additional use and function.

In the scoreboard system discloses in U.S. Pat. No. 5,251,570 each of the scoreboard panels associated therewith is suspended from a support frame. Therefore, whenever it is desired to change the display, move a particular display panel or reverse a panel, it is necessary to manipulate the panels and remove them from the support frame. Thus, each panel must be physically lifted and then physically moved or changed to a different position, afterwhich the panel is again suspended from a support frame.

In U.S. Pat. No. 5,694,881 also to the same inventor as the present invention, a further improvement over prior art scoreboard and other display systems is disclosed. In this patent, the scoreboard or panels are mounted in frames which are designed to be portable. The frames include wheel assemblies which allow the scoreboards to be easily maneuvered and thus positioned in any convenient space to facilitate the display of information recorded or mounted thereon. This is particularly important when utilizing the scoreboards for sporting events, such as in golf, wherein it is necessary to position the scoreboards at different locations during a tournament.

The panels utilized in the scoreboard systems disclosed in the U.S. Pat. No. 5,694,881 are similar to those disclosed in U.S. Pat. No. 5,251,570 and the panels are designed to be suspended from a support frame. Thus, when it is desired to reorient the panels, the panels must be physically lifted from the frame and thereafter reversed or moved and subsequently secured to the supporting frame.

In view of the foregoing, there is a need to provide for a display or scoreboard system which allows double sided displays to be easily maneuvered and changed so that a selected display surface may be orientated toward a viewing area but wherein the scoreboards or panels are not mounted in such a manner which require that they be physically removed from a support frame in order to reorient a display surface, thereby reducing the amount of physical effort necessary to change or reorient a panel of a given display or scoreboard.

SUMMARY OF THE INVENTION

The present invention is directed to display or scoreboards of the type having oppositely oriented display surfaces associated therewith and which may include one or a plurality of separate display panels which are supported by a frame in such a manner that the panels may be rotated about a vertical or horizontal axis with respect to the frame in order to selectively orient the display surfaces. In a preferred embodiment, the frames in which the display panels are mounted are themselves mounted on wheel assemblies such that the entire display or scoreboard system may be conveniently moved.

The invention includes first and second rotary clamps which are designed having opposing jaws which define a channel there-between of a size to frictionally engage either an edge of a display panel or a component of a frame in which the display panels are mounted. Each rotary clamp also includes a generally central pivot post which extends in a direction opposite that of the clamp elements and which is designed to be mounted within an opening formed in either an edge of the display panel or in one of the components of the surrounding support frame.

In a preferred embodiment of the invention, one of the rotary clamps engages an upper edge of a display panel with the edge being defined by a frame which surrounds and is permanently connected to the display panel and with the pivot post extending upwardly through an opening in the upper component of the frame of the system. In this embodiment, the second rotary clamp frictionally engages a lower edge of the display panel with the post thereof being receivable within an opening formed in a portion of the surrounding support frame.

In the preferred embodiment, the outer support frame is slightly larger than the frame defining the edge of the display panel such that the pivot post of the upper clamp may be inserted within the opening in the upper frame component, afterwhich, the pivot post of the lower clamp is aligned with the opening in the lower frame component. Thereafter, the display panel is lowered so that the panel rests on a bearing surface associated with the lower rotary clamp. Utilizing the invention, either one or both of the rotary clamps may include bearing surfaces between the jaw elments and the pivot post associated therewith for facilitating rotation of the panel to which the pivot clamps are secured.

To prevent rotation of the panels within the support frame, the present invention also includes one or more latches which are pivotally mounted to one of the support frame components. Each latch includes an outer portion which is designed to engage an edge portion of the panel to thereby prevent rotation of the panel. In a preferred embodiment, the latches are provided on opposite components of the supporting frame to thereby positively prevent any rotation of the frame until the latches are pivoted to an unlocked position.

In a preferred embodiment, the outer support frame is mounted to standards which are supported on wheel assemblies such that the entire display or scoreboard system may be easily maneuvered.

It is primarily object to the present invention to provide a display or scoreboard system which includes one or more display panels which are pivotally mounted to a support frame by way of clamps which are selectively engageable with opposing edge portions of the supporting frame or the pivotable panels so that either side of the display panels may be selectively displayed by a simple rotation of the panels relative to the support frame and without having to remove the panels from the support frame.

It is another object to the present invention to provide a display or scoreboard system wherein the display may include one or plurality of panels which are rotatable with respect to a support frame and wherein the panels may be locked in a predetermined position by the use of latches mounted to the support frame.

BRIEF DESCRIPTION OF THE DRAWINGS

A better understanding of the invention will be had with respect to the drawing figures wherein:

FIG. 3 is a cross sectional view, having portions broken away, taken along line 3—3 of FIG. 1;

FIG. 4 is an enlarged view showing a latch mechanism of the present invention taken along line 4—4 of FIG. 3 and showing the latch in a locked position relative to the pivotal panel.

FIG. 5 is a view taken along line 4—4 of FIG. 3 showing the latch being moved to an unlocked position to thereby allow rotation of the panel shown in FIG. 1;

FIG. 6 is an enlarged cross sectional view taken along line 6—6 of FIG. 4;

FIG. 7 is an enlarged cross sectional view taken along line 7—7 of FIG. 5;

FIG. 8 is a perspective view of one of the rotary clamps of the present invention;

DESCRIPTION OF PREFERRED EMBODIMENT

Figure 1:
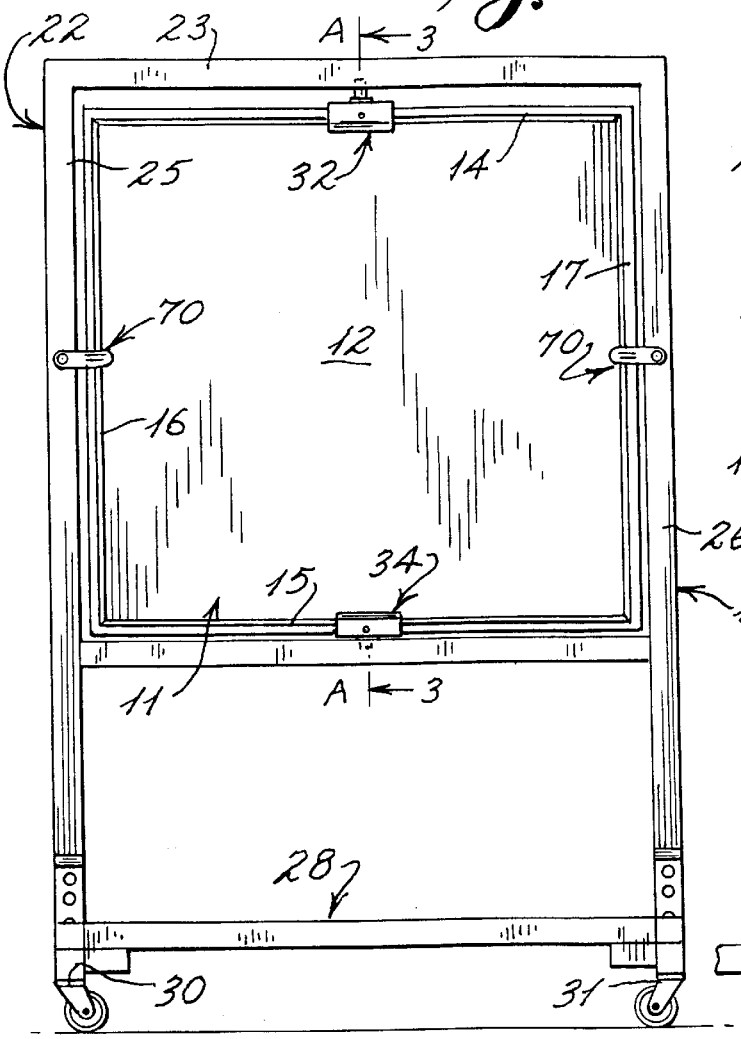
FIG. 1 is a front plan view of a display or scoreboard system including a single display panel which is mounted to a support frame carried by wheel assemblies and showing the rotary clamps and locking components associated with the present invention.
Figure 2:
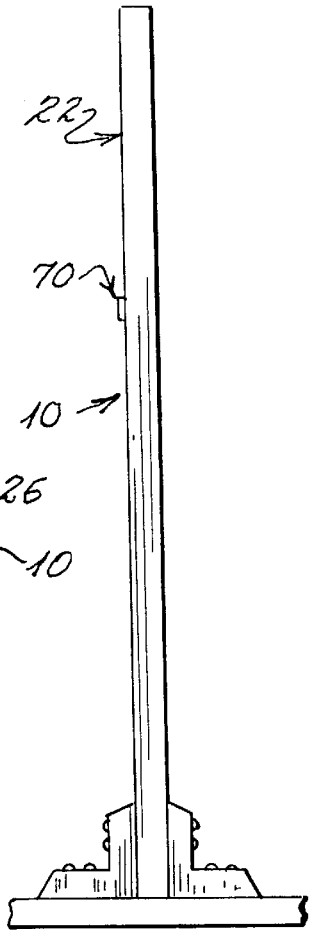
FIG. 2 is a partial side elevational view of the embodiment of FIG. 1.

With continued reference to the drawing figures, a display or scoreboard assembly 10 is shown in FIG. 1 as including a scoreboard or display panel 11 having front and rear surfaces 12 and 13 as shown in FIG. 3. The panel 11 includes upper and lower opposing edges 14 and 15 and side opposing edges 16 and 17 which are defined by a frame 18 which extends completely around the periphery of the panel. As shown in FIG. 1 and in cross section in FIG. 3, the frame is generally U-shaped having opposing clamping portions 19 and 20 which engage the panel such that the frame 18 is permanently secured to the panel.

By way of example only, the panel may be formed of a steel core having an outer porcelain coating such that indicia may be written in ink or other media on either surface 12 or 13 thereof with the media being easily removable utilizing suitable cleaners such as a glass cleaner. The display panel, however, may be formed of other material which allows displays to be placed on either side thereof such as a melamine material or other plastic or a cork or slate material mounted to a suitable core. The invention is therefore not limited to the type of material from which the display panel is manufactured. Further, each display panel may have indicia such as lines or charts already applied thereto or the material of the display panel may have magnetic characteristics allowing various magnetic signs or graphics to be applied to either surface thereof.

The panel 11 is mounted within a support frame 22 which may be manufactured of substantially any material such as wood, plastic or metal. In the preferred embodiment, the support frame 22 is manufacture of a hollow aluminum to make it sturdy and light weight. The frame includes opposing upper and lower components 23 and 24 and opposing side components 25 and 26 which encircle the panel 11. In the preferred embodiment, the side components 25 and 26 extend downwardly to a carriage assembly 28 including dual wheel assemblies 30 and 31 which are mounted at the base thereof. Each wheel assembly includes a pair of outwardly cantilevered wheels which provide a sturdy base for the scoreboard or display system and which allow easy maneuvering of the system during use. The wheel assembly system may be similar to that disclosed in the U.S. Pat. No. 5,694,881, the contents of which are incorporated herein by reference.

With particular reference to FIGS. 1, 3 and 8, the display panel 11 is specifically designed to be rotated so that either surface 12 or 13 thereof is oriented from the front of the system, as shown in FIG. 1. In this respect, the invention includes a pair or rotary clamps 32 and 34 each of which is similar in structure. Each clamp includes a pair of opposing jaws 35 and 36 which define an open channel 37 therebetween. In the preferred embodiment, each jaw includes an inwardly inclined or tapered edge 38 and 39, respectfully, for purposes of facilitating a gripping force when the clamps are in use. To further facilitate the gripping action of the clamps when in use, each of the jaws 35 and 36 may include a slightly inwardly concaved wall portion such as shown at 40 extending along the full length thereof. The clamps may be molded from a plastic material so as to be slightly resilient but strong enough to frictionally retain an edge portion of one of the panels or one of the frame components between the jaws. As opposed to a plastic material, the clamps may also be formed of a metal material, such as aluminum, which is designed to allow a slight resiliency of the opposing jaw elements. However, the jaws 35 and 36 need not always be resilient, as the jaws may be slidingly engaged over upper and lower or side edges defined by the panel 11. The length of each of the clamps 32 and 33 may vary depending upon the size of panel which is to be supported thereby.

Each of the clamps 32 and 34 also includes a pivot post 42 which extends in a direction opposite that of the open channel 37. The pivot post is shown as being cylindrical and extending upwardly from a flat bearing surface 44 which is formed at the base of the post along an outer surface 45 of each clamp. The bearing surface 44 will allow for ease of pivotal movement of a frame or display panel relative to the clamp.

In a preferred embodiment, the display panel 11 is designed to be pivoted about a vertical pivot axis A—A which extends through a line between the pivot posts 42 of each of the clamps 32 and 34, as shown in FIG. 1. In this embodiment, clamp 32 is frictionally mounted over the upper edge 14 of the panel 11 such that the opposing jaws 35 and 36 are engaged against the opposing jaws 19 and 20 of the frame 18 which is secured to the panel 11. An opening 50 is provided in a central portion of the upper frame component 23 in which the pivot post 42 of clamp 32 is selectively received. In a like manner, clamp 34 is frictionally mounted over the lower edge 15 of the frame 11 being seated against the opposing jaws 19 and 20 of the frame 18. The post 42 of the clamp 34, in this embodiment, is inserted within a hole or opening 52 which is in the center of the lower frame component 24 so as to be aligned along the axis A—A with the opening 50 in the upper frame component 23. The pivot shaft 42 of clamp 34 may be somewhat shorter than the pivot post of clamp 32. This is to facilitate mounting of the panel 11 with respect to the support frame.

To install the panel within the support frame, after the clamps 32 and 34 are in place, the panel is lifted such that the post 42 of clamp 32 enters the opening 50 in the upper frame component 23 and the panel is completely elevated and then swung such that the post 42 of the lower clamp 34 is aligned with the opening 52. Thereafter the panel is lowered so that the panel rests on the bearing surface 44 of the clamp 34. To remove the panel, the panel is simply raised such that the bearing surface of the upper clamp 32 engages the frame component 23 which allows the pivot post of clamp 34 to clear the frame component 24 so that the panel 11 may be moved out of engagement with the supporting frame.

It should be noted that, as opposed to rotating about a vertical axis A—A, the panel 11 may be rotated about a horizontal axis by mounting the clamps 32 and 34 along the opposing side edges 16 and 17 thereof and by providing aligned holes or openings in the side components 25 and 26 of the support frame.

Also, as opposed to mounting the clamps 32 and 34 to the panel 11, the clamps may be mounted to the components of the supporting frame. By way of example, clamp 32 may be clampingly engaged along the upper frame component 23 with the pivot post 42 thereof being inserted within an opening provided in the frame 18 which extends around the panel 11. In this embodiment, the lower pivot clamp 34 would clampingly engage the lower frame component 24 of the support frame with the pivot post 42 thereof engaging within an opening provided in the lower edge defined by the frame 18.

Figure 9:
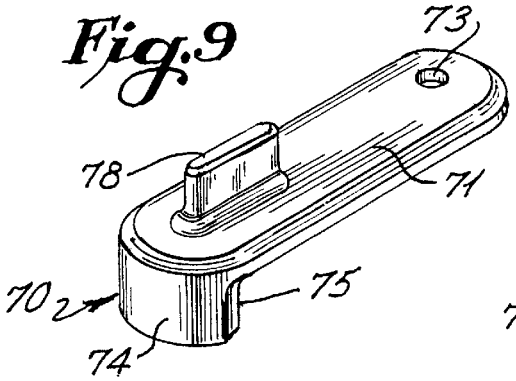
FIG. 9 is a top perspective view of one of the latches of the present invention.
Figure 10:
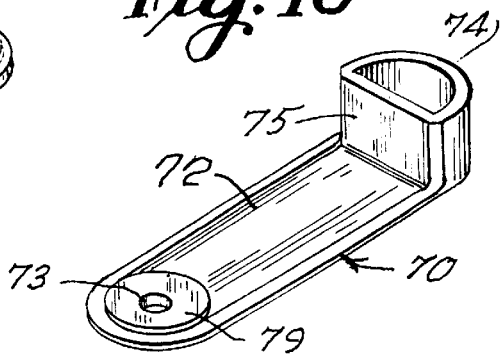
FIG. 10 is a bottom perspective view of the latch shown in FIG. 9.

To prevent rotation of the panel once the panel is installed within the support frame, the present invention also incorporates at least one latch 70 although, in the preferred embodiment, a pair of latches 70 are disclosed in drawing FIG. 1. With particular reference to FIGS. 9 and 10, each latch includes an upper surface 71 and a lower surface 72 which are generally flat and which extend from an opening 73 at one end thereof to an outer end portion 74. The outer end is formed as a depending flange 75 having a convex curvature oriented outwardly relative to the opening 73. To facilitate the manipulation of the latches 70, each latch includes a projection 78 which is engageable to pivot the latch relative to a fastener, such as a screw 80, see FIGS. 4 and 5, by way of which the latches are secured to the components of the outer support frame. The fasteners 80 are inserted through the openings 73 and thus provide a pivot shaft for the latches when in use. To further facilitate the pivoting action of the latches, a bearing surface 79 may be provided in surrounding relationship with respect to the opening 73 along the inner surface 72 thereof.

With specific reference to FIGS. 4 and 5, to prevent the rotation of the panel 11 relative to the supporting frame, the latches are pivoted such that an inner edge of the flange 75 generally abuts an inner surface of the frame 18 which surrounds the panel 11. To permit rotation, the latches 70 are pivoted away from the panel 11 as shown in FIG. 5 utilizing the projections 78 associated therewith. By providing latches on opposite side components of the support frame, the panel 11 is securely retained in an adjusted position such that various information may be applied to the surface of the panel without the panel rotating about the pivot axis A—A.

Although the latches 70 are shown as being mounted on the side components 25 and 26 of the support frame 22, the latches may be applied along the upper and lower frame components 23 and 24 and still provide the locking feature for preventing rotation of the display panel.

Although a single display panel 11 is shown in the drawing figures, it should be noted that the system of the present invention may be utilized with a plurality of panels with each panel incorporating two of the pivot clamps 32, 34 for mounting the panels relative to the support frame.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

I claim:

1. A display apparatus for displaying information comprising:

a display board having opposite upper and lower edges and opposite side edges and first and second oppositely oriented display surfaces;

a support frame having opposite upper and lower components and opposite side components surrounding said display board;

first and second rotary mounting clamps each having opposing jaw elements which define an open channel therebetween of a size to frictionally retain one of said edges of said display board or said components of said support frame therein;

each of said first and second rotary mounting clamps having a pivot post extending from said opposing jaws in a direction opposite to said open channel, each pivot post being of a size to be seated within an opening provided in one of said edges of said display board or said components of said support frame, whereby when said clamps are secured to opposite ones of said edges of said display board or said components of said support frame, said display board is pivotable about an axis defined between said pivot posts which are seated within openings in an adjacent one or the other of said edges of said display board or said components of said support frame; and at least one latch pivotably mounted to one of said frame components, said at least one latch having an end portion including a flange extending outwardly therefrom for engaging said display board adjacent one of said edges to thereby prevent rotation of said display board about said axis.

2. The display apparatus of claim 1 including a plurality of said latches mounted to spaced said components of said support frame.

3. The display apparatus of claim 2 wherein each of said plurality of latches includes a projection extending outwardly therefrom in a direction opposite said flanges, said projections being engageable for manipulating said latches.

4. The display apparatus of claim 1 wherein said pivot post of one of said first and second rotary mounting clamps is relatively shorter than said pivot post of the other of said first and second rotary mounting clamps.

5. The display apparatus of claim 4 wherein each of said first and second rotary mounting clamps includes a bearing surface at a base of said pivot post.

6. The display apparatus of claim 1 wherein said opposite upper and lower edges and said opposite side edges of said display board are defined by elements of a frame in which a panel defining said oppositely oriented display surfaces is mounted.

7. The display apparatus of claim 6 wherein said first and second clamps are frictionally mounted to said upper and lower edges of said display board, respectively, with said pivot post being received within openings in said upper and lower frame components.

8. The display apparatus of claim 1 wherein each of said first and second rotary mounting clamps includes a bearing surface at a base of said pivot post.

9. The display apparatus of claim 1 in which said support frame includes a base, and wheel means for supporting said base.

10. A rotary clamp and latch set adapted for supporting and selectively retaining a display apparatus in a support frame wherein the display apparatus includes a display board having opposite upper and lower edges and opposite side edges and first and second oppositely oriented display surfaces and wherein the support frame includes opposite upper and lower components and opposite side components which surround the display board, the rotary clamp and latch set including; a pair of rotary clamps having opposing jaw elements defining an open channel therebetween of a size which is adapted to frictionally retain one of said edges of said display board or said support frame components therein and a pivot post extending from each said rotary clamps in a direction opposite to said open channel, a bearing surface provided at a base of each said pivot posts, and a pair of latches adapted to be mounted to the components of the support frame, and each of said latches including a flange portion extending outwardly therefrom and adapted to engage said display board adjacent said edges thereof.

* * * * *